US008881744B2

(12) United States Patent
McKinstry

(10) Patent No.: US 8,881,744 B2
(45) Date of Patent: Nov. 11, 2014

(54) LASH HOLDER

(71) Applicant: Lin Shu-Hui McKinstry, Tustin, CA (US)

(72) Inventor: Lin Shu-Hui McKinstry, Tustin, CA (US)

( * ) Notice: Subject to any disclaimer, the term of this patent is extended or adjusted under 35 U.S.C. 154(b) by 0 days.

(21) Appl. No.: 13/660,657

(22) Filed: Oct. 25, 2012

(65) Prior Publication Data

US 2014/0116459 A1 May 1, 2014

(51) Int. Cl.
*A41G 5/02* (2006.01)

(52) U.S. Cl.
CPC ..... *A41G 5/02* (2013.01)
USPC ..... 132/216

(58) Field of Classification Search
CPC ..... A41G 5/02
USPC ..... 132/216, 333; 224/217; 433/49, 163; 206/63.5; 248/74.1, 74.3, 309.1, 309.2; 211/65, 70.6, 70.7
See application file for complete search history.

(56) References Cited

U.S. PATENT DOCUMENTS

| | | | | | |
|---|---|---|---|---|---|
| 615,336 | A * | 12/1898 | Adams | 24/623 |
| 2,176,052 | A * | 10/1939 | Beyer | 132/331 |
| 3,200,823 | A * | 8/1965 | Sebastian | 132/216 |
| 3,327,391 | A * | 6/1967 | Malm | 433/163 |
| 5,052,417 | A * | 10/1991 | Cordova | 132/216 |
| 5,732,862 | A * | 3/1998 | Bull | 224/217 |
| 6,397,633 | B1 * | 6/2002 | Wu | 63/1.11 |
| 7,222,629 | B1 * | 5/2007 | Han | 132/216 |
| D669,223 | S * | 10/2012 | Lee et al. | D28/73 |
| 8,701,685 | B2 * | 4/2014 | Chipman | 132/201 |
| 2013/0133681 | A1 * | 5/2013 | Chipman | 132/201 |

* cited by examiner

*Primary Examiner* — Robyn Doan
*Assistant Examiner* — Tatiana Nobrega
(74) *Attorney, Agent, or Firm* — Snell & Wilmer LLP

(57) ABSTRACT

A lash holder having a U-shaped sheet comprising of a curved top part and a bottom part fixed at a designated place; the curved top part is intended for setting at least one strip with numerous lashes for increasing, enlarging and separating the space between the top of the lashes, so that it is easy for the user to take off individual lashes.

14 Claims, 8 Drawing Sheets

LASH HOLDER

BACKGROUND

1. Field

The present invention relates to a lash holder, particularly to a lash holder, which increases and enlarges the space between individual synthetic eyelashes, so that the user can take off the individual lashes easily.

2. Background

Eyelashes are a main focal point when it comes to your eyes, which is often enhanced by lengthening or curling the eyelashes to get a more beautiful look of the face. On the commercial market, there are one piece strip lash extensions, which can be adhered to human eyelids after a length adjustment on the human lashes are made. However the uniform styles of the one piece strip lash extensions cannot really fulfill or satisfy individual preferences. One piece strip lash extensions just do not look as natural as natural lashes do.

Therefore, another method for lengthening natural eyelashes has been devised, taking individual synthetic lashes from a strip, and manually inserting the lash onto a human's individual eyelash; one lash at a time, until the proposed look is complete. This method is called "lash to lash eyelash extensions" and has at least two advantages over one piece strip lash extensions: 1. One can choose the best suitable length of synthetic lashes according to the varying length of each natural lash, so a better overall look of the eye will be achieved; 2. Everyone can choose their length & style of lashes according to their personal preference thus getting the results they want each and every time according to their desires.

As shown in FIG. 8, an eyelash assembly 5 comprises: a strip 51, wherein a bottom part of the strip is attached to a holder, and numerous lashes 52 are separated at the top part of the strip. Individual synthetic lashes are first taken off and then applied onto the human individual lash. A user can take off varying lengths of lashes for matching the customer's personal preferences.

In conventional eyelash extensions procedures, normally the user places the lash strip on the back of the hand, or other flat device like a table or tray so that it is easy to take off lashes. However, this method results in (a) hygienic problems and (b) procedure is not very efficient. Furthermore, since the lashes are adhered on the strip, the space G1 between lashes is so tiny, it is not easy for a user to take off the individual lashes and thus waste time and even product as sometime lashes stick to each other, eliminating their use as they cannot be separated easily and have to be thrown away as they cannot be touched by human hands. Furthermore, this conventional method does not showcase the lashes, but rather hides them from the clients.

SUMMARY

The main object of the present invention is to provide a lash holder, wherein the space between the lashes at the top is increased, enlarged and separated, so that it is easier for a user to take off the individual synthetic lashes one at a time.

For achieving above object the lash holder of the present invention has a U-shaped sheet comprising of a curved top part and a bottom part fixed at a designated place; at least one strip with numerous synthetic lashes is set on the top part, so that the space between the individual lashes is increased, enlarged and separated so a user can take off individual lashes much easier than ever before.

Another object of the present invention is to provide a lash holder, which is fixed at a designated place, so that a user can easily take off lashes and increase efficiency of the procedure.

For achieving above objects the lash holder of the present invention comprises: a rod at the bottom part combining a fixed component comprising a C-shaped sleeve for encompassing a human hand therein and a• connecting pedestal at the top of the C-shaped sleeve; the bottom end of the rod is plugged in the connecting pedestal; the lash holder is fixed on the hand by the fixed component, so that it is easy for users to take off lashes.

Other aspects and advantages of the present invention will become apparent from the following detailed description, taken in conjunction with the accompanying drawings, illustrating by way of example the principles of the present invention.

DETAILED DESCRIPTION

Figure 1:
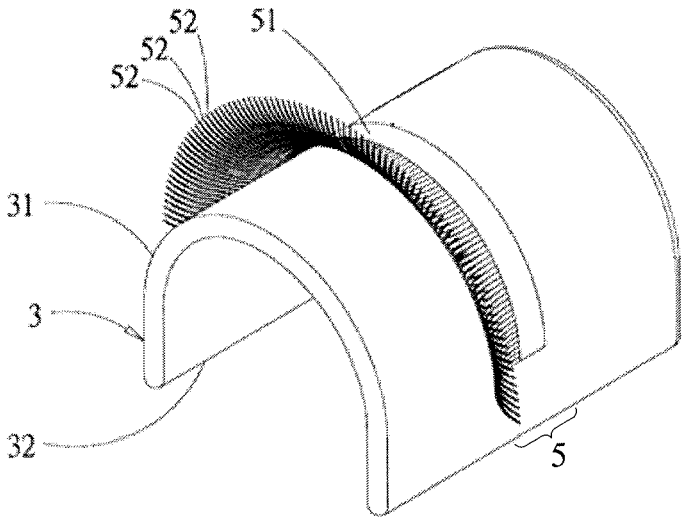
FIG. 1 is a perspective view of the lash holder of the present invention.

As shown in FIG. 1, the lash holder 3 of the present invention having a U-shaped sheet comprised of a curved top part 31 and a bottom part 32 fixed on a destined place; wherein an eyelash assembly 5 that includes a strip 51 connected to numerous lashes 52 is set thereon. Due to the curved top part 31 the space between individual lashes 52 are increased, enlarged and separated automatically, so the user can take off individual lashes 52 very easy.

The eyelash assembly 5 used in the present invention is a conventional product. The eyelash assembly 5 comprises: a strip 51, whose bottom part is adhered to the top part 31 of the lash holder 3; and numerous lashes 52 are at the top of the strip 51. So the user can take off individual lashes 52 of the eyelash assembly 5 to adhere onto human lashes.

Figure 2:
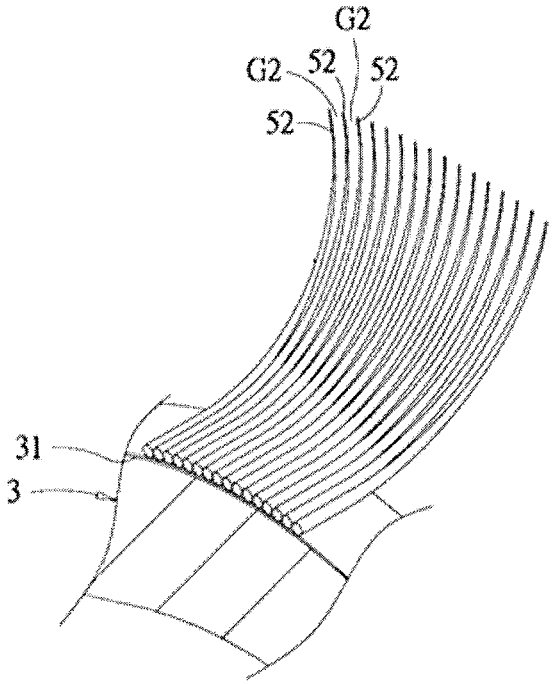
FIG. 2 is a partial perspective view of lashes strip set on the present invention.

FIG. 2 is a partial perspective view of the lashes strip set on the lash holder.

As shown in FIG. 2, as the lash strip 51 is attached to the top part 31 of the lash holder 3, due to the curved top part 31 the space G2 between individual lashes 52 that are connected to the strip 5 is increased, enlarged and thus separates the lashes automatically, so that user can take off individual lashes 52 more easily.

Figure 3:
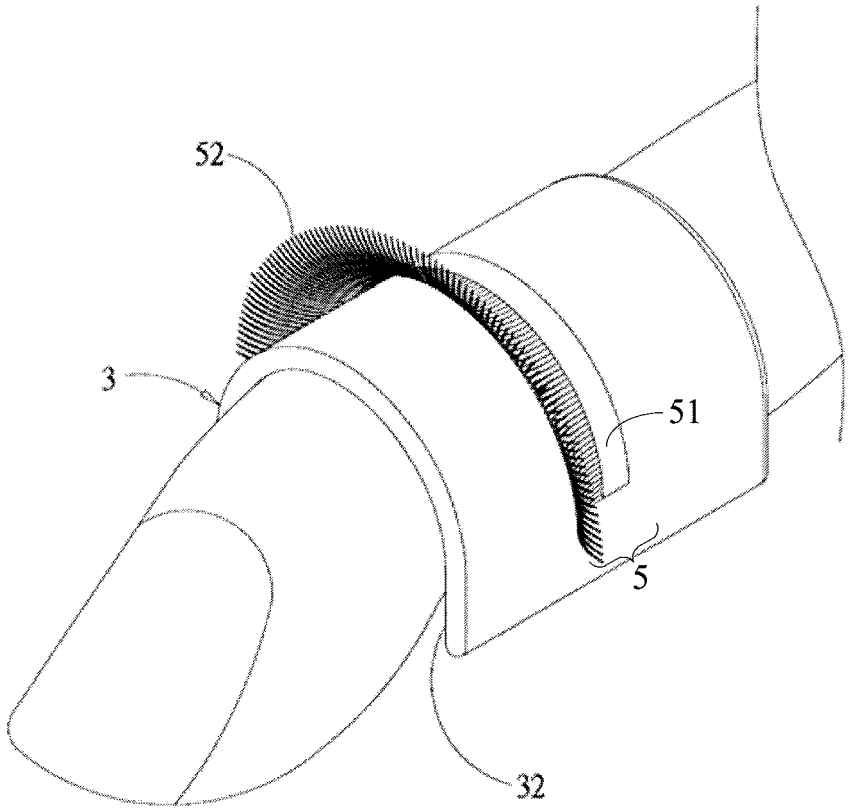
FIG. 3 is a perspective view of the lash holder of the present invention with a lashes strip set thereon, encompassing a human finger.

As shown in FIG. 3, the lash holder 3 is fixed on part of human hand (like finger, wrist or any other part) or any parts from where it is easy to take off the lashes 52 that are connected to the strip. For example, the lash holder is open at the bottom for encompassing a part of a hand, like fingers. So a user can take off the lashes 52 more easily.

Figure 4:
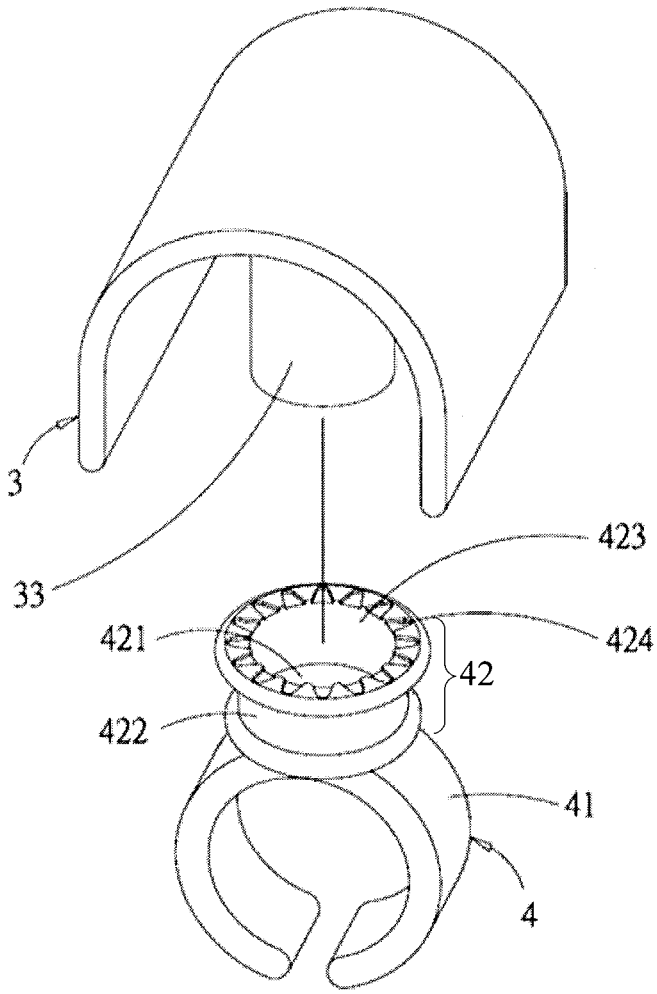
FIG. 4 is an exploded view of the second embodiment of the present invention, showing the fixed component.
Figure 5:
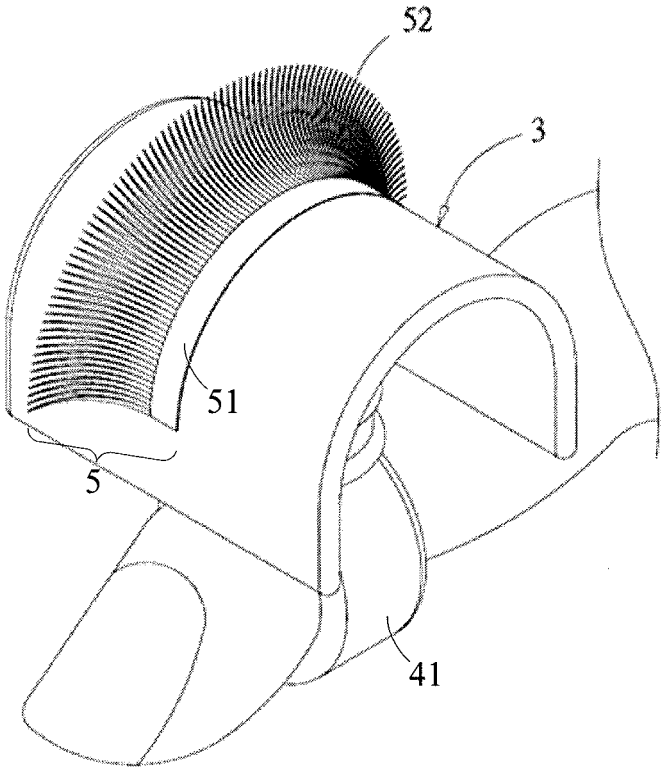
FIG. 5 is a perspective view of the second embodiment of the present invention, showing rotation of the rod.

As shown in FIG. 4-5, in the second embodiment of the present invention, the lash holder 3 is fixed on a part of the hand (like fingers, wrist or any other part) or any part from where it is easy to take off the strip 51, by a fixed component. The lash holder 3 comprises a rod 33 at the bottom, combined further with a fixed component 4 comprising a C-shaped sleeve 41 for encompassing part of the human hand therein, like finger, and a connecting pedestal 42 set at the top part of the C-shaped sleeve 41; the bottom end of the rod 33 is plugged in the connecting pedestal 42. The lash holder 3 is fixed on a human finger by the fixed component 4, so that user can take off the lashes easily.

There are various methods for combining the connecting pedestal 42 with the rod 33. For this explanation, only one embodiment is described. The connecting pedestal 42 comprises: a bottom component 421 set on the top of the C-shaped sleeve 41, and a sidewall 422 circling around the edge of the said bottom component 421 and building together with this bottom component a reservoir 423; the bottom end of the said rod 33 is for plugging in the said reservoir 423 of the connecting pedestal 42. Alternatively the rod 33 can have a groove/notch at the bottom for connecting the connecting pedestal 42, having a rod-shape for plugging in the groove at the top (not shown).

At the top of the sidewall of the connecting pedestal 42 there is at least one groove/notch 424 for the said rod 33 to plug in the reservoir 423 of the said connecting pedestal 42.

The rod 33 has a round section and is running fit with the reservoir 423 of the connecting pedestal 42.

As shown in FIG. 5, the rod is rotatable, so the lash holder 3 as well as lashes strip 51 are also rotatable, thence the user can easily take off lashes 52 that are connected to the strip 5 from different angles.

Figure 6:
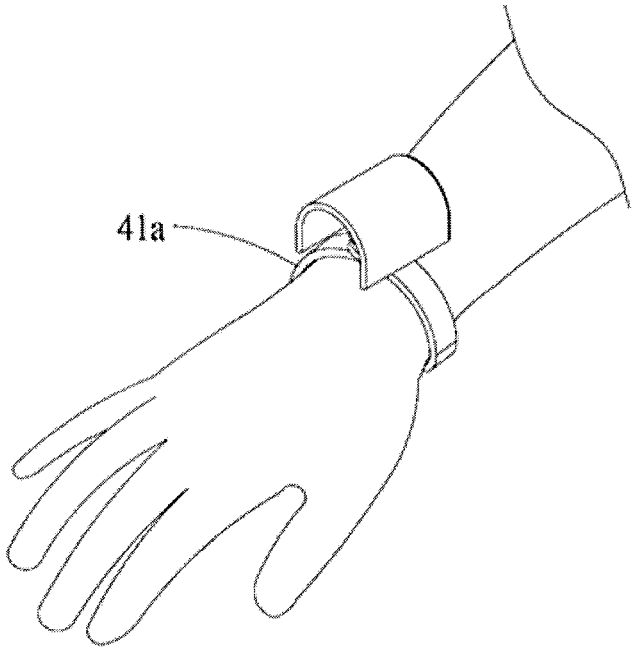
FIG. 6 is a perspective view of the third embodiment of the present invention, showing a variant of the fixed component.

FIG. 6 shows the third embodiment of the present invention, the C-shaped sleeve 41*a* is intended for encompassing the wrist therein.

Figure 7:
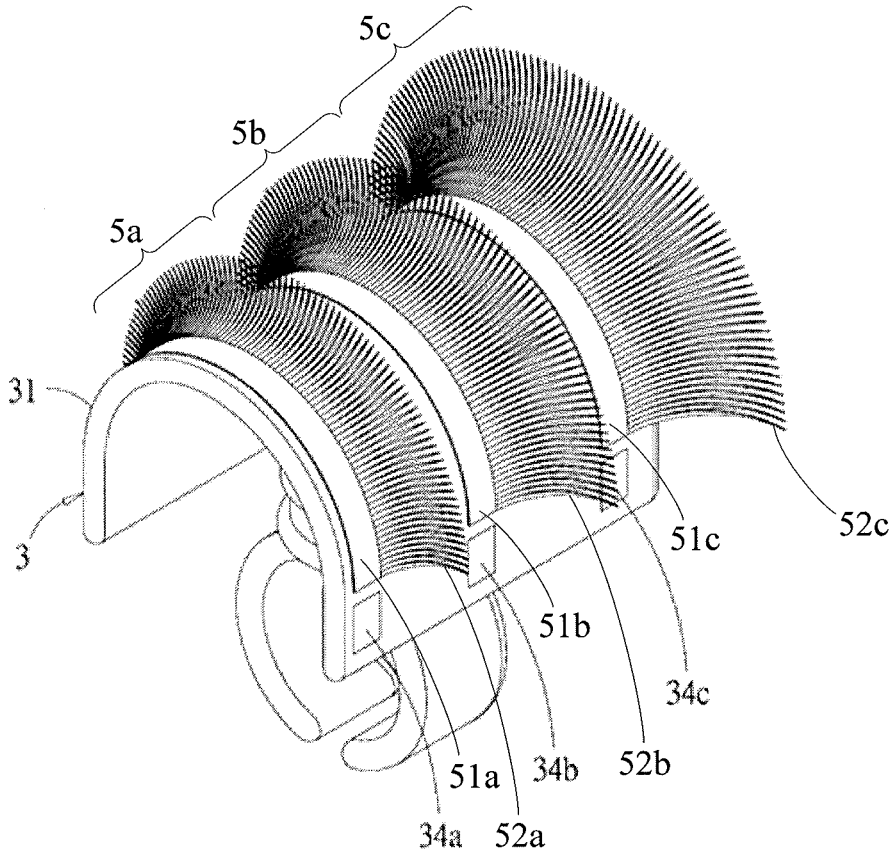
FIG. 7 is a perspective view of the fourth embodiment of the present invention, showing three variant strips of lashes set on the lash holder.
Figure 8:
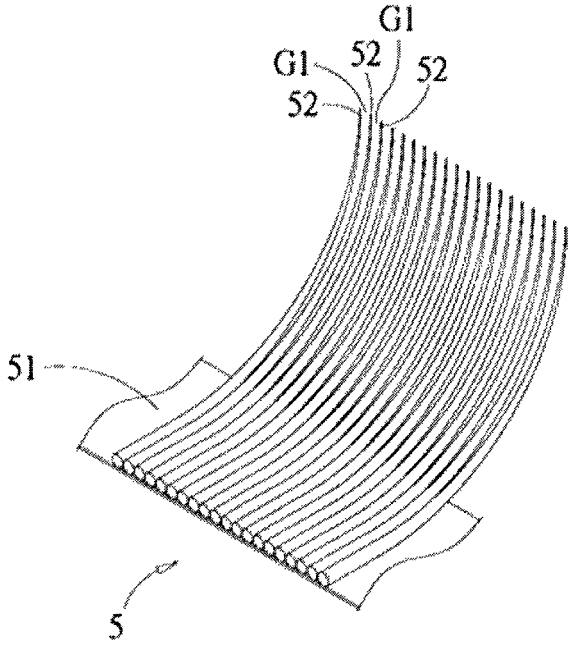
FIG. 8 (PRIOR ART)
FIG. 8 is a partial perspective view of a conventional lash strip.

FIG. 7 shows eyelash assemblies 5*a*, 5*b*, and 5*c* having strips 51*a*, 51*b*, and 51*c* that are connected to lashes 52*a*, 52*b*, and 52*c*, respectively, in decreased lengths adhered to the present invention.

As shown in FIG. 7 the top part 31 of the lash holder 3 is intended for engraving marks, like trade mark, customers name, website or other markings. For an explanation, only one example is described. The top part 31 of the lash holder 3 has several different marks 34*a*, 34*b*, 34*c*, like S, M, L, so overlapping of lashes is avoided, when various lengths of lashes strips are adhered to. The identification marks are adhered to the paper strips on the lash holder 3; it is also feasible, if notches or projections are set on the lash holder 3 as marks.

While preferred embodiments of the invention have been set forth for the purpose of disclosure, modifications of the disclosed embodiments of the invention as well as other embodiments thereof may occur to those skilled in the art of eyelash extensions. Accordingly, the appended claims are intended to cover all embodiments which do not depart from the spirit and scope of the invention.

The invention claimed is:

1. A lash holder comprising:

a sleeve defining a hollow portion for insertion of a finger of a user;

a pedestal having a bottom portion connected to the sleeve, and a cylindrical portion connected to the bottom portion of the pedestal, the cylindrical portion defining a cavity therein;

a rod having a top surface and a bottom surface, at least a portion of the rod positioned within the cavity of the pedestal;

a top part having an inner surface and an outer surface, the top part including a central curved portion with a curved inner surface connected to the top surface of the rod and a curved outer surface, a first vertical end portion extending from a first side of the central curved portion, and a second vertical end portion extending from a second side of the central curved portion opposite the first side, wherein the central curved portion, the first vertical end portion, and the second vertical end portion are oriented towards the bottom surface of the rod;

a strip having a width and a length that is substantially longer than the width and extends along the outer surface of the top part from a proximity of the first vertical end portion along the curved outer surface of the central curved portion to a proximity of the second vertical end portion; and a plurality of lashes that are connected to the strip, extrude away from the outer surface substantially perpendicular to the length of the strip, each lash of the plurality of lashes having a base end connected to the strip and a distal free end, two adjacently positioned lashes of the plurality of lashes having two distal free ends, respectively, that are separated by a space, wherein an overall contour or shape of the top part is configured to increase the space between adjacent lashes making the space therebetween larger due to the strip being positioned along the outer surface of the top part as compared to if the strip were positioned on a flat surface, enhancing a user's ability to easily take off individual lashes from the plurality of lashes.

2. The lash holder of claim 1, wherein the rod, the top part and the strip are configured to rotate with respect to the pedestal in response to a rotating force applied to the outer surface of the top part.

3. The lash holder of claim 1, wherein the sleeve is C-shaped and has a top portion connected to the pedestal and a bottom opening positioned opposite the top portion of the sleeve.

4. The lash holder of claim 1, wherein the pedestal further includes a round top portion connected to the cylindrical portion and having a diameter that is greater than a diameter of the cylindrical portion, and the cavity is defined within the round top portion and the cylindrical portion.

5. The lash holder of claim 4, wherein the round top portion of the pedestal has a plurality of grooves or notches.

6. The lash holder of claim 5, wherein the plurality of grooves or notches are equispaced apart from one another positioned around an entire perimeter of the round top portion of the pedestal and configured to allow the rod to plug in the cavity of the pedestal.

7. The lash holder of claim 1, wherein the outer surface of the top part includes an engraved mark positioned on the outer surface of the top part and adjacent to the strip.

8. The lash holder of claim 1, wherein the outer surface of the top part includes:

a first engraved mark positioned on the outer surface of the top part and adjacent to the strip, and a second engraved mark positioned adjacent to an area of the outer surface of the top part for placement of a second strip connected to a second plurality of lashes.

9. A lash holder comprising:

a C-shaped ring having a bottom opening, the C-shaped ring defining a hollow portion for insertion of a finger of a user;

a pedestal having a round bottom portion connected to the C-shaped ring, and a cylindrical portion connected to the round bottom portion of the pedestal, the cylinder defining a cavity therein;

a rod having a top surface and a bottom surface, at least a portion of the rod positioned within the cavity of the pedestal, the rod being configured to rotate with respect to the pedestal;

a top part having an inner surface and an outer surface, the top part including a central curved portion with a curved inner surface connected to the top surface of the rod and a curved outer surface, a first vertical end portion extending from a first side of the central curved portion, and a second vertical end portion extending from a second side of the central curved portion opposite the first side, wherein the central curved portion, the first vertical end portion, and the second vertical end portion are oriented towards the bottom surface of the rod;

a strip having a width and a length that is substantially longer than the width and extends along the outer surface of the top part from a proximity of the first vertical end portion along the curved outer surface of the central curved portion to a proximity of the second vertical end portion; and a plurality of lashes that are connected to the strip, extrude away from the outer surface substantially perpendicular to the length of the strip, each lash of the plurality of lashes having a base end connected to the strip and a distal free end, two adjacently positioned lashes of the plurality of lashes having two distal free ends, respectively, that are separated by a space, wherein an overall contour or shape of the top part is configured to increase the space between adjacent lashes making the space therebetween larger due to the strip being positioned along the outer surface of the to part as compared to if the strip were positioned on a flat surface, enhancing a user's ability to easily take off individual lashes from the plurality of lashes.

10. The lash holder of claim 9, wherein the rod, the top part and the strip are configured to rotate with respect to the pedestal in response to a rotating force applied to the outer surface of the top part.

11. The lash holder of claim 9, wherein the pedestal further includes a round top portion connected to the cylinder and having a diameter that is greater than a diameter of the cylinder, and the reservoir is defined within the round top portion and the cylinder.

12. The lash holder of claim 11, wherein the round top portion of the pedestal has a plurality of grooves or notches that are equispaced apart from one another and positioned around an entire perimeter of the round top portion of the pedestal, the plurality of groves or notches configured to allow the rod to plug in the reservoir of the pedestal.

13. The lash holder of claim 9, wherein the outer surface of the top part includes an engraved mark on the outer surface of the top part and adjacent to the strip.

14. The lash holder of claim 9, wherein the outer surface of the top part includes:

a first engraved mark positioned on the outer surface of the top part and adjacent to the strip, and a second engraved mark positioned adjacent to an area of the outer surface of the top part for placement of a second strip connected to a second plurality of lashes.

* * * * *